United States Patent [19]

Kambe et al.

[11] Patent Number: 4,936,757

[45] Date of Patent: Jun. 26, 1990

[54] MULTI-SECTION VACUUM PUMP

[75] Inventors: Shigeharu Kambe, Kawasaki; Tutomu Higuchi, Yokohama, both of Japan

[73] Assignee: Unozawa-Gumi Iron Works, Ltd., Tokyo, Japan

[21] Appl. No.: 415,099

[22] Filed: Sep. 29, 1989

[30] Foreign Application Priority Data

Oct. 7, 1988 [JP] Japan ..... 63-251994

[51] Int. Cl.[5] ..... F04B 39/02; F04B 39/06

[52] U.S. Cl. ..... 417/373; 417/423.6; 417/423.8; 417/423.13

[58] Field of Search ..... 417/247, 372, 373, 423.1, 417/423.5, 423.6, 423.8, 423.13, 423.14

[56] References Cited

U.S. PATENT DOCUMENTS 3,734,637 5/1973 Beck, Jr. ..... 417/423.6 X
4,143,999 5/1979 Ryall ..... 417/423.6

FOREIGN PATENT DOCUMENTS 0290662 11/1988 European Pat. Off. .

*Primary Examiner*—John Rivell
*Attorney, Agent, or Firm*—Merchant, Gould, Smith, Edell, Welter & Schmidt

[57] ABSTRACT

A multi-section vacuum pump includes a pump portion, an intermediate shaft portion provided between the pump portion and an external drive shaft, a drive shaft portion including a drive shaft having a drive gear for driving the intermediate shaft portion and a shaft seal structure on the drive shaft, and a gear box accommodating the timing gear set, the intermediate gear, and the drive gear and allowing the lubricating oil to be reserved at the bottom thereof. The drive shaft portion includes, at the bottom of the drive shaft in the shaft seal structure, oil supply for supplying lubricating oil to an oil reservoir having an oil overflow opening communicating with the gear box, a lubricating oil path for introducing the lubricating oil reservoir being provided having an oil overflow opening communicating with the gear box, a lubricating oil path for introducing the lubrication oil to the oil reservoir being provided inside the drive shaft. Accordingly, a compression heat and a vibration of the pump portion are not transmitted to a fixed ring of the shaft seal structure in the drive shaft portion, the relationship between the rotational speed of the drive shaft and the rotational speed of the rotor support shafts is selected by a drive transmission mechanism, and the circumferential speed of a thrust plane of the shaft seal structure in the drive shaft portion is selected to be an optimum speed.

1 Claim, 8 Drawing Sheets

MULTI-SECTION VACUUM PUMP

BACKGROUND OF THE INVENTION

1. Field of the Invention

The present invention relates to a multi-section vacuum pump including a drive shaft having a shaft seal structure on the drive shaft. The multi-section vacuum pump according to the present invention is applicable to a multi-section dry type vacuum pump which is operated at a high compression ratio in the range of a suction pressure as low as $10^{-3}$ Torr at a relatively high temperature.

2. Description of the Related Arts

In general, in a dry type vacuum pump, a leakage of air from without to within the pump must be as small as possible, to realize a pump having a high performance, and when pumping a combustible or corrosive gas, it is particularly important from the viewpoints of safety and corrosion-resistibility to minimize the intrusion of oxygen and moisture contained in the atmosphere inside the pump. In a prior art multi-section dry-sealed vacuum pump which is operated, in particular, at a high compression ratio and at a relatively high operating temperature due to the compression heat, since the pump is driven by a motor or the like installed outside the pump, a drive shaft must be passed through the housing of the pump to the outside of the pump, and accordingly, a shaft seal structure must be mounted on a drive shaft protruding portion to seal same.

In a three-section vacuum pump as shown in FIGS. 8 and 9, a portion where a drive shaft 101 passing outward through the housing of the pump is provided with a lubricating oil reservoir 106 accommodating a combination of a fixed ring 103 and a rotary ring 104, in which the fixed ring 103 of a bearing is secured inside the lubricating oil reservoir 106, the rotary ring 104 slidingly rotates together with the drive shaft on an inner surface of the fixed ring 103, and the thrust surface between the fixed ring 103 and the rotary ring 104 is supplied with lubricating oil reserved at and splashed from the lubricating oil reservoir 106 by a splasher 105 attached to a driven shaft 102 which rotates in a reverse direction to that of the drive shaft 101 while driven thereby via timing gear set 109. Further, lubricating oil in the reservoir 106 is cooled by cooling water flowing in a cooling water path 107 provided under the reservoir 106.

The lubrication of the thrust surface between the fixed ring 103 and the rotary ring 104 of the bearing is carried out by a splasher 105 which is attached to and driven through the driven shaft 102 and splashes the periphery of the thrust surface with lubricating oil. Nevertheless, it is difficult to obtain a necessary and sufficient amount of lubrication by an operation of a splasher, and thus an incomplete lubrication of the thrust plane of a mechanical seal occurs, and accordingly, a leakage of the atmosphere into the pump may occur.

Since the drive shaft 101 is directly connected to the rotors 108 of the pump, the temperature of which is elevated due to the compression heat during operation, the temperature of the drive shaft 101 is also elevated due to a heat conduction, and further, the temperature of the rotary ring 104 of the bearing installed on the drive shaft 101 becomes relatively high. Thus, because of a compression heat, a deformation of the thrust surface occurs between the rotary ring 104 and the fixed ring 103, which may allow a leakage of the atmosphere into the pump.

The drive shaft 101 directly connected with the rotors 108 of the pump is subjected to a vibration generated when the rotors transfer and compress a gas, and such vibration adversely affects the formation of an oil film on the thrust surface between the rotary ring 104 and the fixed ring 103 of the bearing, and thus causes a problem in that a leakage of the atmosphere into the pump may occur.

Also, since the drive shaft 101 is directly connected with the rotors 108, the rotational speed of the drive shaft 101 is selected on the basis of the rotational speed of the rotors necessary for maintaining the performance of the pump, and therefore, a disadvantage arises in that the circumferential speed of the thrust surface between the fixed ring 103 of the bearing and the rotary ring 104 of the bearing rotating together with the drive shaft 101 cannot be optimized.

To eliminate the problems described above, the realization of a pump having a high operation performance without a leakage of the atmosphere into the pump, and in particular, when pumping an inflammable or corrosive gas, an improvement of the safety and corrosion resistance of the pump is strongly desired.

SUMMARY OF THE INVENTION

An object of the present invention is to provide a device in which a compression heat and vibration, generated during operation at pairs of rotors each constituting a pump section, and generated while the rotors are transferring and compressing a gas, are not transmitted to a shaft seal structure, an adequate amount of lubricating oil is supplied to the shaft seal structure for maintaining a good lubrication of a thrust plane of the shaft seal structure, an appropriate shaft seal structure is constituted, and the shaft seal structure is well cooled.

Another object of the present invention is to provide a device in which a circumferential speed of a thrust plane of the shaft seal structure is optimized by selecting an optimum relationship between the rotational speed of the drive shaft having the shaft seal structure and the rotational speed of the rotor support shaft by a drive transmission mechanism, and a leakage of the atmosphere through the shaft seal structure into the pump is prevented.

According to the present invention, there is provided a multi-section vacuum pump having a pump portion including a plurality of pump sections each having pump rotors for transferring and compressing a gas, two vertical rotor support shafts common to the plurality of pump sections for supporting the pump rotors, and a timing gear set at the bottoms of the rotor support shafts. An intermediate shaft portion provided between the pump portion and an external drive shaft has an intermediate gear for transmitting the rotational motion of the drive shaft to one gear of the timing gear set. A drive shaft portion includes a drive shaft having a drive gear for driving the intermediate shaft portion and a shaft seal structure on the drive shaft. A gear box accommodates the timing gear set, the intermediate gear, and the drive gear and allows the lubricating oil to be reserved at the bottom thereof. The drive shaft portion includes, at the bottom of the drive shaft in the shaft seal structure, an oil supply means for supplying lubricating oil to an oil reservoir having an oil overflow opening communicating with the gear box; a lubricating oil path for introducing oil to the oil reservoir being provided inside the drive shaft. Accordingly, a compression heat and a vibration of the pump portion are not transmitted to a fixed ring of the shaft seal structure in the drive shaft portion, the relationship between the rotational speed of the drive shaft and the rotational speed of the rotor support shafts is selected by a drive transmission mechanism, and the circumferential speed of a thrust plane of the shaft seal structure in the drive shaft portion is selected to be a predetermined speed.

With respect to a drive system and a shaft seal structure of a device according to the present invention, a description of the mode of operation thereof will be given as follows.

In addition to two rotor support shafts for supporting the rotors, the temperature of which rises during operation when a gas is transferred and compressed by a rotation of the rotors, which is accompanied by vibration, a drive shaft is separately provided to be driven by a motor or the like installed outside the pump, and this additional drive shaft drives one gear of the timing gear set located at the bottom of two rotor support shafts through a drive transmission mechanism, so that a compression heat and a vibration of the pump portion are not directly transmitted to the shaft seal structure arranged on the drive shaft, the optimum circumferential speed on a thrust plane of the shaft seal structure arranged on the drive shaft is determined by selecting an appropriate ratio of the rotational speed of the drive shaft to the rotational speed of the rotor supports, and the rotational speed of the drive shaft is changed to provide a rotational speed of the rotors necessary to maintain the operation of the pump. Further, lubricating oil reserved at the bottom of a gear box is cooled by a cooling device in the gear box, and a sufficient amount of lubricating oil is supplied to an oil reservoir arranged around the shaft seal structure by a pump portion located at the bottom of the vertical drive shaft through a lubricating oil path provided in the drive shaft. The lubricating oil lubricates and cools the thrust plane of the shaft seal structure, and then is returned to the gear box through an oil overflow opening located in the upper portion of the lubricating oil reservoir.

DESCRIPTION OF THE PREFERRED EMBODIMENTS

Figure 1:
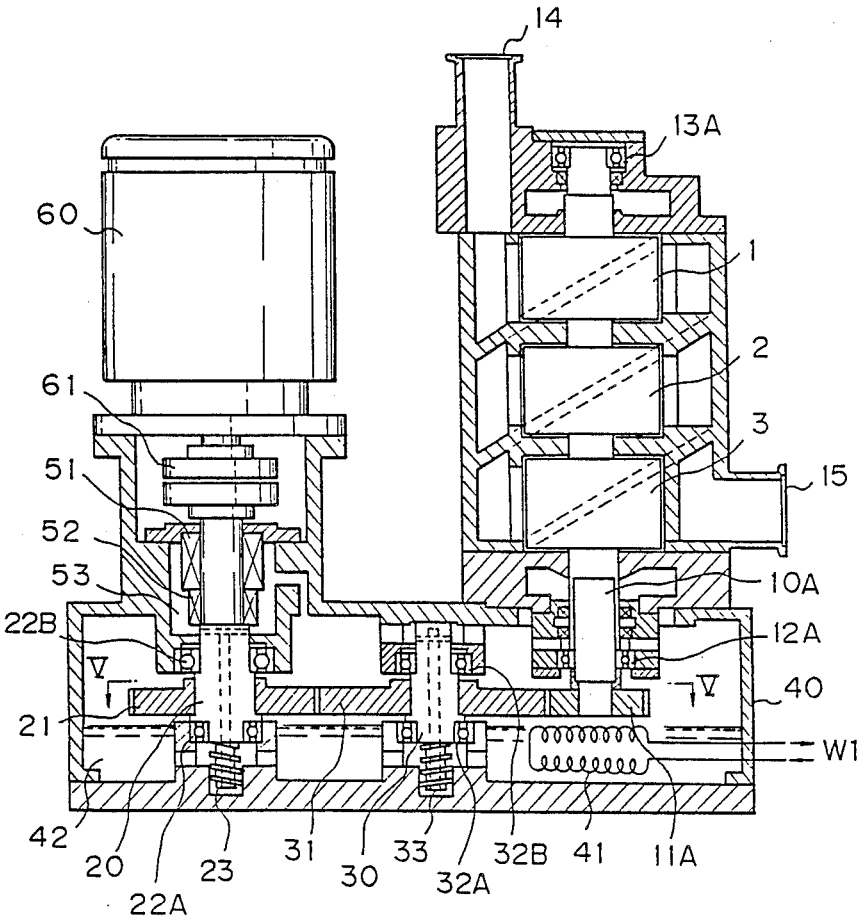
FIG. 1 is a schematic diagram of a 3-section dry-sealed vacuum pump according to an embodiment of the present invention.
Figure 2:
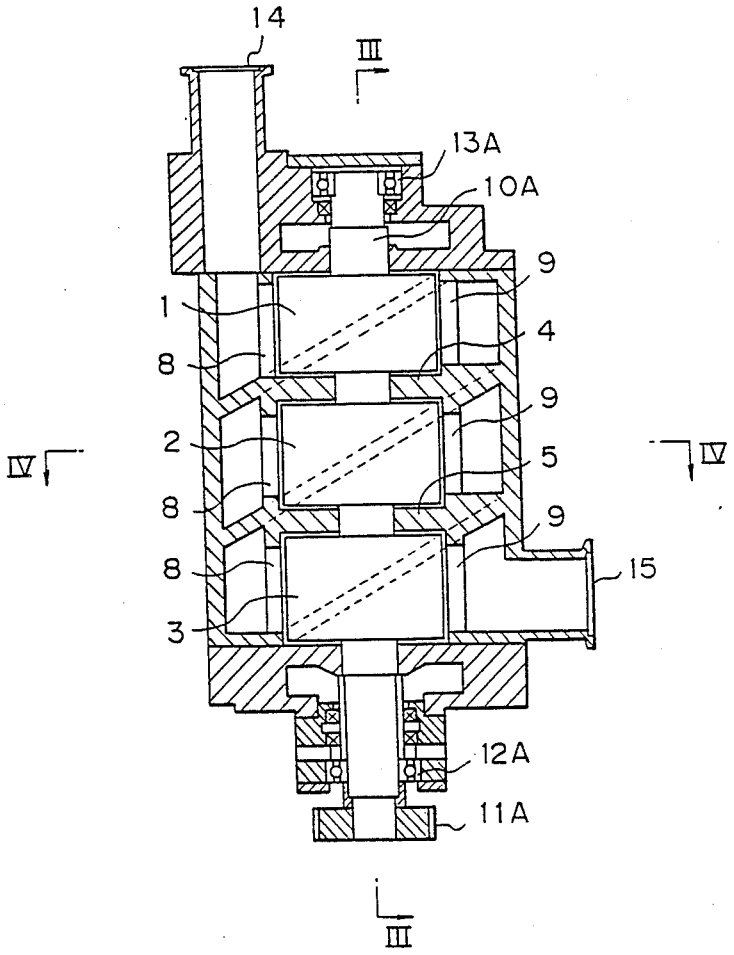
FIG. 2 is an enlarged view of the pump portion shown in FIG. 1.
Figure 3:
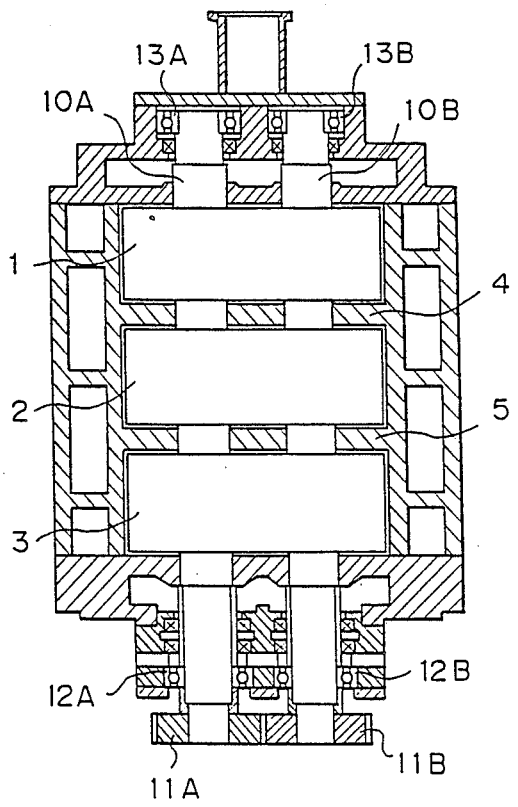
FIG. 3 is a cross-sectional view of the pump portion taken along the line III—III in FIG. 2.
Figure 4:
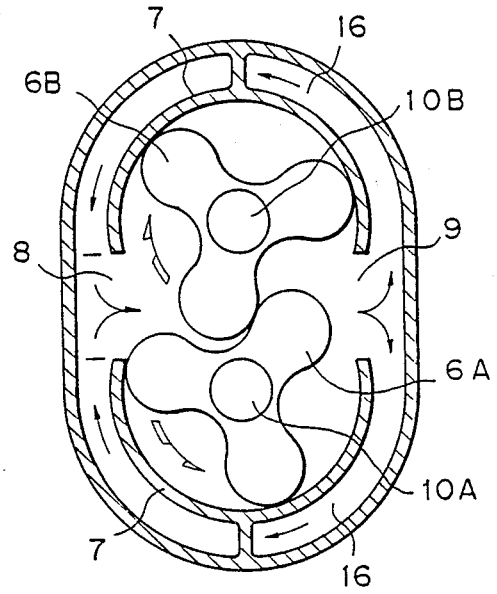
FIG. 4 is a cross-sectional view of the pump portion taken along the line IV—IV in FIG. 2.
Figure 5:
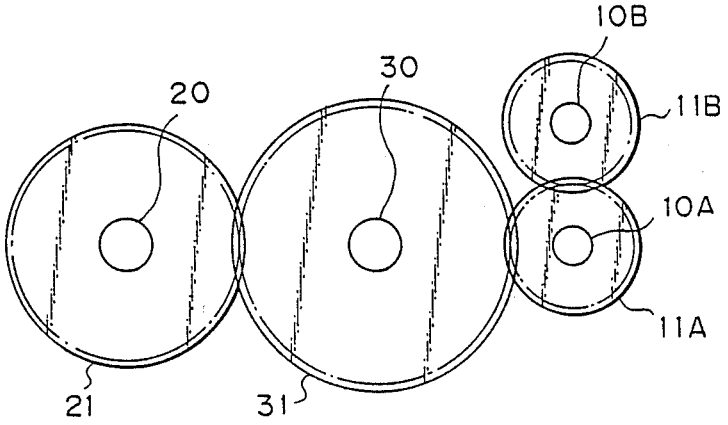
FIG. 5 shows an arrangement of the gears on a cross section of the pump in FIG. 1.
Figure 6:
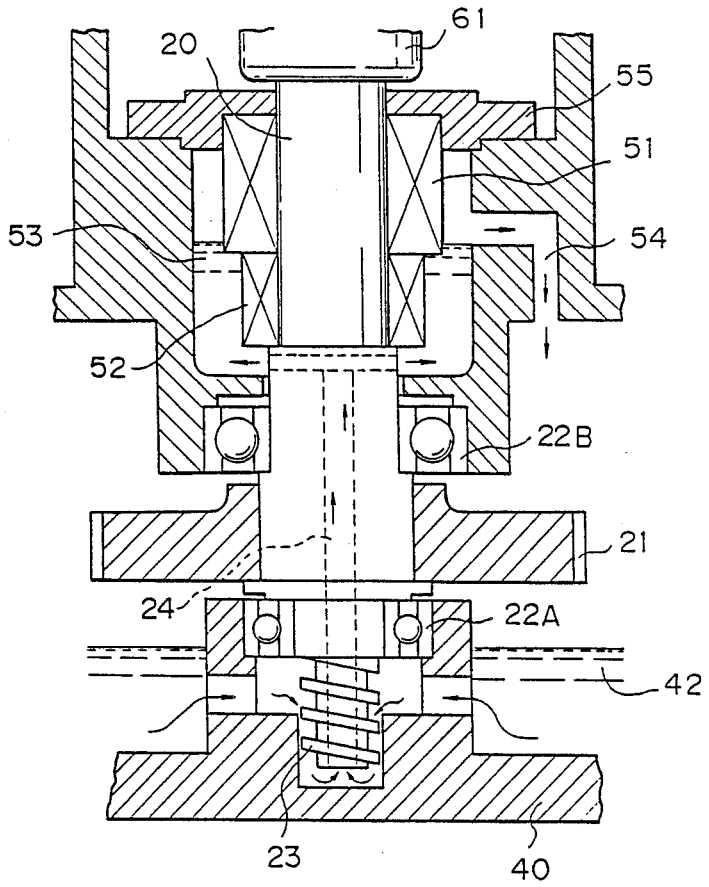
FIGS. 6 and 7 are partially enlarged views of a drive shaft portion and an intermediate shaft portion of the pump in FIG. 1.
Figure 7:
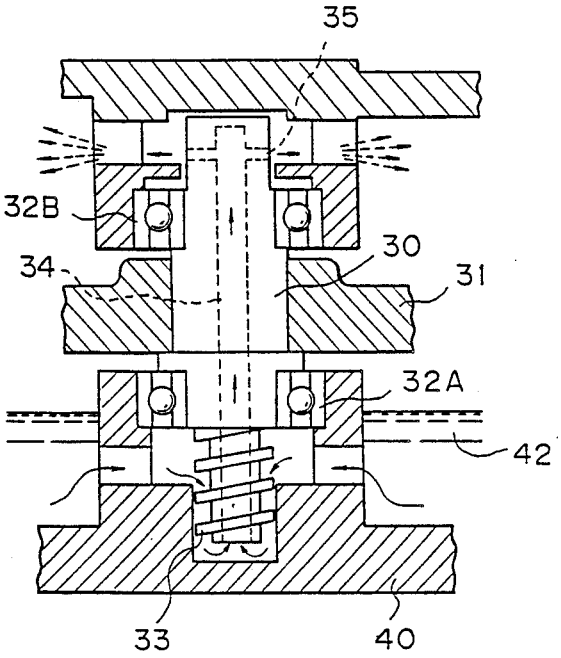
Figure 8:
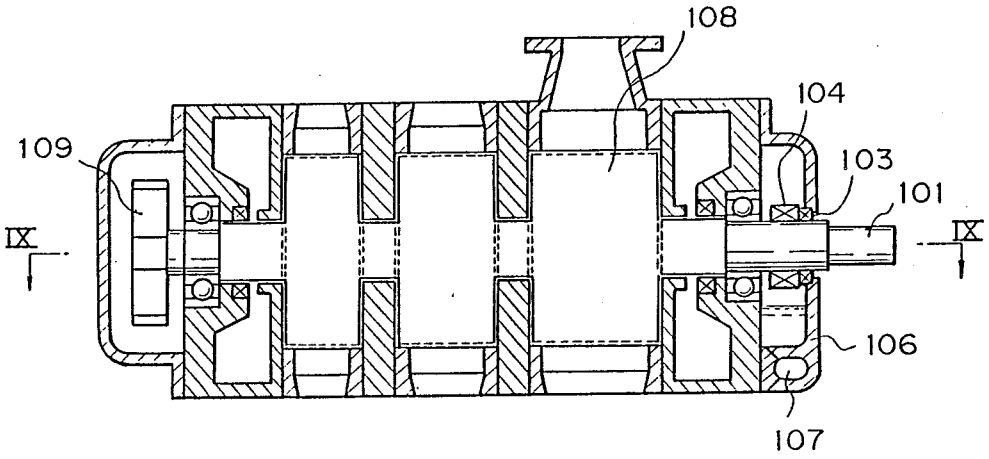
Fig. 8 (PRIOR ART)
FIG. 8 shows an example of a prior art 3-section dry-sealed vacuum pump.
Figure 9:
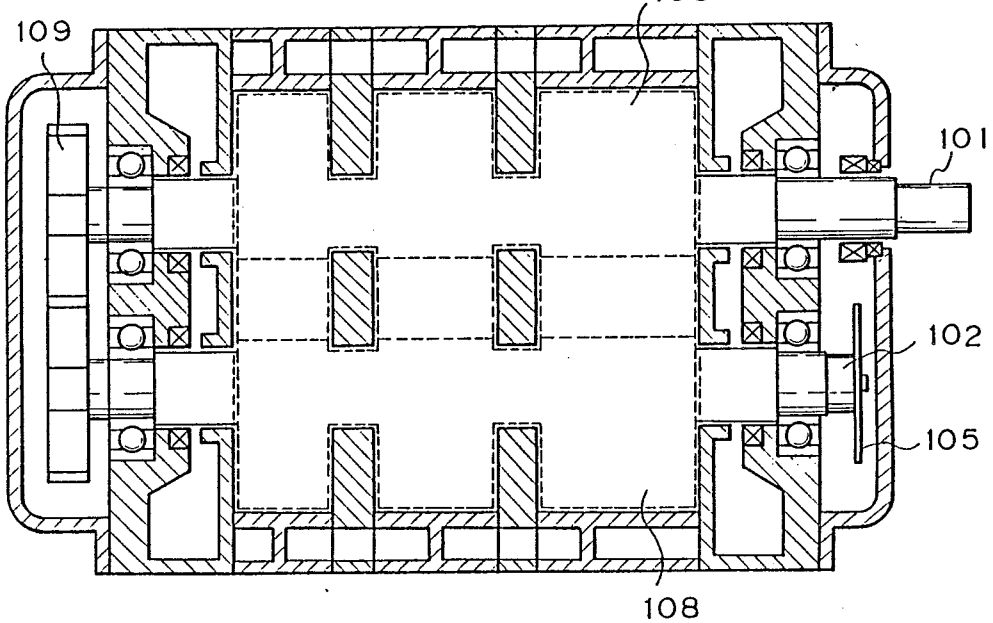
Fig. 9 (PRIOR ART)
FIG. 9 is a cross-sectional view of the device in FIG. 8 taken along the line IX—IX.

FIG. 1 shows the construction of a 3-section Roots type vacuum pump as a multi-section dry-sealed vacuum pump according to an embodiment of the present invention; FIG. 2 is an enlarged view of the pump in FIG. 1; FIG. 3 is a cross-sectional view of the main body of the pump taken along the line III—III in FIG. 2; FIG. 4 is a cross-sectional view of the pump taken along the line IV—IV in FIG. 2; FIG. 5 shows an arrangement of the gears in a cross-sectional view of the pump taken along the line V—V in FIG. 1; and FIGS. 6 and 7 are partially enlarged views of the drive shaft portion and the intermediate shaft portion in FIG. 1.

The construction of the pump portion is described below. Referring to FIGS. 2 and 3, the first pump section 1 and the second pump section 2 are separated by an intersection wall 4, and the second pump section 2 and the third pump section 3 are separated by an intersection wall 5. As shown in FIG. 3, vertically positioned rotor support shafts 10A and 10B, supported between upper bearings 13A, 13B and lower bearings 12A, 12B, pass through a specific pump section and are made to rotate in opposite directions by a timing gear set 11A, 11B. The construction of each pump section is as set forth below. As shown in FIGS. 2 and 4, each pump section includes a housing 7 having an inlet 8 and an outlet 9, and a pair of rotors 6A and 6B supported by a pair of shafts 10A and 10B. A peripheral gas passage 16 is arranged around the housing 7, and the passage runs through the outlet 9 and extends to the next pump section.

The constructions of the drive shaft portion and the shaft seal structure are described as follows. As shown in FIG. 1, a vertically positioned drive shaft 20 is driven by a motor installed outside the pump via a coupling 61, an intermediate shaft 30 is arranged in vertical position between the drive shaft 20 and the rotor support shaft 10A, the drive shaft 20 is equipped with a drive gear 21, the intermediate shaft 30 is equipped with an intermediate gear 31, and two rotor support shafts 10A and 10B are incorporated with timing gears 11A and 11B at the bottoms thereof respectively. In FIG. 5, one gear 11A of the timing gear set 11A and 11B is arranged to be driven by a drive gear 21 through an intermediate gear 31.

In FIG. 1, an enclosed gear box 40 includes a drive gear 21, an intermediate gear 31, and a timing gear set 11A, 11B, bearings 22A, 22B for supporting the drive shaft 20, bearings 32A, 32B for supporting the intermediate shaft 30, and bearings 12A, 12B for supporting the rotor support shafts at the bottoms thereof. The gear box reserves the lubricating oil 42 at the bottom thereof, and includes a cooling device for cooling the reserved lubricating oil. In FIGS. 1 and 6, a rotary ring 52 of the shaft seal structure for eliminating a leakage of the atmosphere into the pump is mounted on the drive shaft 20, an oil overflow opening 54 having an upper portion communicating with the gear box is arranged around the rotary ring 52, and a fixed ring 51 of the shaft seal structure is secured on the lid of the lubricating oil reservoir 53. Further, an oil supply system 23 for supplying lubricating oil 42 to the oil reservoir 53 is installed at the bottom of the drive shaft 20, and a lubricating oil path 24 is provided inside the drive shaft 20 to lead lubricating oil from the oil supply system 23 to the lubricating oil reservoir 53. In FIGS. 1 and 7, an oil supply system 33 for supplying lubricating oil from the bottom of the gear box to the upper portion of the intermediate shaft is installed at the bottom of the intermediate shaft 30, and a lubricating oil path 34 is provided in the intermediate shaft 30 up to a release opening 35 which opens in a centrifugal direction on the intermediate shaft 30 to lead lubricating oil 42 to the location of the opening 35 of the intermediate shaft 30.

The modes of operation of the driving system of the pump and the shaft seal structure of the drive shaft are described as follows. As shown in FIGS. 1 to 3, during the operation, a gas is inhaled through an inlet 14 into the pump, successively transferred and compressed in the first pump section 1, the second pump section 2 and the third pump section 3, by two rotors 6A and 6B included in the housing 7, and discharged from the pump through the outlet 15. In this case, the rotors 6A and 6B compress a gas at a high compression ratio, and thus the temperature of the rotors is raised. On the other hand, the transfer and compression operation of a gas is accompanied by a pulsatory motion of the gas pressure, and a vibration of the rotors occurs.

In the device of FIG. 1, in addition to two rotor supporting shafts 10A and 10B for supporting the rotors, an drive shaft 20 is separately provided to be driven by a motor 60 installed outside the pump through a coupling 61, and this additional drive shaft drives one gear 11A of the timing gear set 11A, 11B located at the bottom of two rotor support shafts 10A and 10B by a drive gear 21 included on the drive shaft 20 through an intermediate gear 31 installed on the intermediate shaft 31 so that a compression heat and a vibration of the pump are not transmitted to the fixed ring 52 of the shaft seal structure arranged on the drive shaft 20, the optimum circumferential speed of a thrust plane of the shaft seal structure arranged on the drive shaft is determined by selecting an appropriate ratio of the number of teeth of the drive gear to the number of teeth of the timing gear, and the rotational speed of the drive shaft is changed to the rotational speed of the rotors necessary to maintain the operation of the pump.

In FIGS. 1 and 6, the lubricating oil 42 reserved at the bottom of a gear box 40 is cooled by cooling water W1 flowing in a cooling device 41, a sufficient amount of lubricating oil is supplied to an oil reservoir 53 arranged around the rotary ring 52 of the shaft seal structure through a lubricating oil path 24 provided in the drive shaft 20, and then the lubricating oil lubricates the thrust plane between the fixed ring 51 and rotary ring 52 of the shaft seal structure in good condition, cools the shaft seal structure 51, 52, and is returned to the gear box 40 through an oil overflow opening 54 located in the upper portion of the lubricating oil reservoir 53.

Further, as shown in FIGS. 1 and 7, the lubricating oil 42 reserved at the bottom of the gear box 40 is cooled by cooling water W1 flowing in the cooling device 41, delivered to a release opening 35 radially positioned in the upper portion of the intermediate shaft 30, by an oil supply unit 33 installed at the bottom of the vertically positioned intermediate shaft 30, through the lubricating oil path 34 provided inside the intermediate shaft 30, and the lubricating oil is then atomized and discharged into the gear box 40 by a centrifugal force generated by a rotation of the intermediate shaft 30, and effectively lubricates and cools all gears and bearings in the gear box 40 by a mist lubrication.

As described above, in a 3-section Roots type vacuum pump, which is one type of the multi-section dry-sealed vacuum pump according to the present of cooled lubricating oil 42 from a lubricating oil reservoir to the inside and the vicinity of the shaft seal structure, installed at the bottom of the drive shaft, lubricated a thrust plane of the shaft seal structure, and cools the shaft seal structure. Furthermore, in addition to two rotor support shafts for supporting the rotors, the temperature of which is raised during operation when a gas is transferred and compressed by a rotation of the rotors, which is accompanied by a vibration, a drive shaft is separately provided to be driven by a motor installed outside the pump, and this additional drive shaft drives one gear of the timing gear set located at the bottom of two rotor support shafts, by a drive gear attached on the drive shaft through an intermediate gear secured on the intermediate shaft, so that a compression heat and a vibration of the pump are not directly transmitted to the shaft seal structure arranged on the drive shaft. On the other hand, the optimum circumferential speed on a thrust plane of the shaft seal structure 51, 52 arranged on the drive shaft is determined by selecting an appropriate ratio of the number of teeth of the drive gear 21 to the number of teeth of the timing gear 11A, and the rotational speed of the drive shaft 20 is changed to the rotational speed of the rotors 6A and 6B necessary to maintain the operation of the pump.

Cooled lubricating oil is delivered to a release opening radially positioned in the upper portion of the intermediate shaft by an oil supply unit installed at the bottom of the intermediate shaft, the lubricating oil is atomized and discharged into the gear box by a centrifugal force generated by a rotation of the intermediate shaft, and an effective mist lubrication and cooling of all gears in the gear box and of the shaft seal structure is carried out.

The detailed description given hereinbefore was of a pump having three pump sections, but the multi-section dry-sealed vacuum pump according to the present invention is not limited to three but can be constituted by four or more sections.

Further, a reverse flow cooling means can be applied to the multi-section Roots type vacuum pump of FIG. 1. For example, reference can be made to Japanese Unexamined Patent Publication (Kokai) No. 59-115489, and Japanese Unexamined Patent Publication (Kokai) No. 63-154884.

In the multi-section vacuum pump of FIG. 1, a drive shaft is provided separately from two rotor support shafts for supporting the rotors, the temperature of which rises during operation when a gas is transferred and compressed by a rotation of the rotors, which is accompanied by vibration, to be driven by a motor installed outside the pump, and one gear of the timing gear set located at the bottom of two rotor support shafts is driven by a drive gear attached to the additional driveshaft through an intermediate gear fixed on the intermediate shaft so that a compression heat and a vibration of the pump are not directly transmitted to the shaft seal structure arranged on the drive shaft. The lubricating oil reserved at the bottom of the gear box is cooled by a cooling device in the gear box, a sufficient amount of the lubricating oil is supplied to an oil reservoir arranged around the shaft seal structure by an oil supply unit located at the bottom of the vertically positioned drive shaft through a lubricating oil path provided in the drive shaft, the lubricating oil lubricates the thrust plane of the shaft seal structure and cools the shaft seal structure whereby thus the shaft seal structure is appropriately constituted. Further, the optimum circumferential speed of the thrust plane of the shaft seal structure arranged on the drive shaft can be determined by selecting the ratio of the number of teeth of the drive gear to the number of teeth of the timing gear, and by optimizing the relationship between the rotation speed of the drive shaft and the rotation speed of the rotor support shafts by a drive transmission mechanism having an intermediate gear, without changing the rotational speed of the rotors to maintain the operation of the pump, so that an incomplete lubrication of the thrust plane and a leakage of the open air into the pump through the shaft seal structure are prevented, and thus a high performance pump without leakage of the atmosphere therein can be realized.

Further, other than a gear transmission unit, a pulley transmission unit may be used as driving force transmission means for transmitting the driving force from the drive shaft to the rotor support shafts.

What is claimed:

1. A multi-section vacuum pump comprising:

a pump portion including a plurality of pump sections each having pump rotors for transferring and compressing a gas, two vertical rotor support shafts common to said plurality of pump sections for supporting said pump rotors and a timing gear set at the bottoms of said rotor support shafts;

an intermediate shaft portion provided between said pump portion and an external drive shaft having an intermediate gear for transmitting the rotational motion of said drive shaft to one gear of said timing gear set;

a drive shaft portion comprising a drive shaft having a drive gear for driving said intermediate shaft portion and a shaft seal structure on said drive shaft; and a gear box accommodating said timing gear set, said intermediate gear, and said drive gear and allowing the lubricating oil to be reserved at the bottom thereof;

said drive shaft portion including, at the bottom of said drive shaft in said shaft seal structure, oil supply means for supplying lubricating oil to an oil reservoir having an oil overflow opening communicating with said gear box, a lubricating oil path for introducing the lubrication oil to said oil reservoir being provided inside said drive shaft;

whereby a compression heat and a vibration of the pump portion are not transmitted to a fixed ring of the shaft seal structure in said drive shaft portion, the relationship between the rotational speed of the drive shaft and the rotational speed of the rotor support shafts is selected by a drive transmission mechanism, and the circumferential speed of a thrust plane of the shaft seal structure in said drive shaft portion is selected to be an optimum speed.

* * * * *

UNITED STATES PATENT AND TRADEMARK OFFICE

CERTIFICATE OF CORRECTION

PATENT NO. : 4,936,757

DATED : June 26, 1990

INVENTOR(S) : S. Kambe et al.

It is certified that error appears in the above-identified patent and that said Letters Patent is hereby corrected as shown below:

COLUMN 4, LINE 12,

DELETE indentation, i.e., -the line IV-IV- should immediately follow "along" in LINE 11 as part of the same paragraph

COLUMN 6, LINE 3,

INSERT --invention, a pump unit for supplying a sufficient amount-- after "present"

COLUMN 6, LINE 6,

DELETE "lubricated" and INSERT therefor --lubricates--

COLUMN 6, LINE 57,

DELETE "driveshaft" and INSERT therefor --drive shaft--

Signed and Sealed this

Tenth Day of November, 1992

*Attest:*

DOUGLAS B. COMER

*Attesting Officer*

*Acting Commissioner of Patents and Trademarks*